US011512372B2

(12) United States Patent
Hu

(10) Patent No.: US 11,512,372 B2
(45) Date of Patent: Nov. 29, 2022

(54) POWDER METAL COMPOSITION FOR EASY MACHINING

(71) Applicant: HÖGANÄS AB (PUBL), Höganäs (SE)

(72) Inventor: Bo Hu, Greensburg, PA (US)

(73) Assignee: HÖGANÄS AB (PUBL), Höganäs (SE)

( * ) Notice: Subject to any disclaimer, the term of this patent is extended or adjusted under 35 U.S.C. 154(b) by 266 days.

(21) Appl. No.: 15/548,387

(22) PCT Filed: Feb. 1, 2016

(86) PCT No.: PCT/EP2016/052048

§ 371 (c)(1),
(2) Date: Aug. 2, 2017

(87) PCT Pub. No.: WO2016/124532

PCT Pub. Date: Aug. 11, 2016

(65) Prior Publication Data

US 2018/0016664 A1 Jan. 18, 2018

(30) Foreign Application Priority Data

Feb. 3, 2015 (EP) ..... 15153617

(51) Int. Cl.
*B22F 3/00* (2021.01)
*C22C 29/00* (2006.01)
(Continued)

(52) U.S. Cl.
CPC ..... *C22C 33/0228* (2013.01); *B22F 3/16* (2013.01); *B22F 3/24* (2013.01); *B22F 2003/248* (2013.01); *B22F 2301/35* (2013.01)

(58) Field of Classification Search
None
See application file for complete search history.

(56) References Cited

U.S. PATENT DOCUMENTS 4,274,875 A 6/1981 Cadle et al.
4,927,461 A 5/1990 Ciloglu et al.
(Continued)

FOREIGN PATENT DOCUMENTS

CN 101516549 A 8/2009
CN 101925683 A 12/2010
(Continued)

OTHER PUBLICATIONS

Ishimine et al., machine translation of JP 2010-031365, Feb. 12, 2010 (Year: 2010).*

(Continued)

*Primary Examiner* — Mary I Omori
(74) *Attorney, Agent, or Firm* — Buchanan Ingersoll & Rooney P.C.

(57) ABSTRACT

An iron-based powder composition including at least an iron-based powder, and a minor amount of a machinability enhancing additive, said additive including at least one titanate compound. The titanate compound being according to the following formula; MxO*nTiO2, wherein x can be 1 or 2 and n is a number from at least 1 and below 20, preferably below 10. M is an alkali metal such as Li, Na, K or an alkaline earth metal such as Mg, Ca, Ba, or combinations thereof. Further, the use of the machinability enhancing additive and a method for producing an iron-based sintered component for easy machining.

9 Claims, 3 Drawing Sheets

New cutting edge before use

Edge wear after cutting Mix No 6 for 54 mm

Edge wear after cutting Mix No 7 for 3240 mm

(51) Int. Cl.

| | |
|---|---|
| ***C22C 33/02*** | (2006.01) |
| ***B22F 3/16*** | (2006.01) |
| ***B22F 3/24*** | (2006.01) |

(56) References Cited

U.S. PATENT DOCUMENTS

| | | | | |
|---|---|---|---|---|
| 5,631,431 | A | 5/1997 | Andersson | |
| 5,938,814 | A | 8/1999 | Uenosono et al. | |
| 6,139,598 | A | 10/2000 | Narasimhan et al. | |
| 6,214,080 | B1 | 4/2001 | Narasimhan et al. | |
| 6,677,041 | B1 * | 1/2004 | Ogawa | C01G 23/005 106/428 |
| 7,300,490 | B2 | 11/2007 | Ozaki et al. | |
| 2007/0199409 | A1 | 8/2007 | Andersson | |
| 2008/0019858 | A1 | 1/2008 | Mars et al. | |
| 2009/0041608 | A1 | 2/2009 | Ozaki et al. | |
| 2010/0316521 | A1 | 12/2010 | Litstrom et al. | |
| 2011/0262294 | A1 | 10/2011 | Andersson et al. | |
| 2014/0341771 | A1 | 11/2014 | Andersson et al. | |
| 2016/0151837 | A1 | 6/2016 | Nushiro et al. | |

FOREIGN PATENT DOCUMENTS

| | | | | |
|---|---|---|---|---|
| CN | 103898410 | A | * | 7/2014 |
| CN | 103898410 | A | | 7/2014 |
| CN | 103934453 | A | | 7/2014 |
| EP | 0 183 666 | A1 | | 6/1986 |
| EP | 1 002 883 | A1 | | 5/2000 |
| EP | 1 985 393 | A1 | | 10/2008 |
| JP | H 01-255604 | A | | 10/1989 |
| JP | H01-279167 | A | | 11/1989 |
| JP | H07-086860 | A | | 3/1995 |
| JP | H 08-095649 | A | | 4/1996 |
| JP | H 09-279204 | A | | 10/1997 |
| JP | H 10-317002 | A | | 12/1998 |
| JP | 2004156063 | A | * | 6/2004 |
| JP | 2010-031365 | A | | 2/2010 |
| JP | 2012-144801 | A | | 8/2012 |
| JP | 2014-080683 | A | | 5/2014 |
| JP | 2014-80683 | A | | 5/2014 |
| RU | 2162390 | C1 | | 1/2001 |
| RU | 2529128 | C2 | | 9/2014 |
| WO | WO 2005/102567 | A1 | | 11/2005 |
| WO | WO 2010/074627 | A1 | | 7/2010 |
| WO | 2015008406 | A1 | | 1/2015 |

OTHER PUBLICATIONS

Unami et al., machine translation JP 2004-156063, Jun. 3, 2004 (Year: 2004).*

Rajender Singh, Introduction to Basic Manufacturing Processes and Workshop Technology, 2006 (Year: 2006).*

Liu et al., Investigation the Effect of Particle Size Distribution on Processing Parameters Optimisation in Selective Laser Melting Process, Jan. 2011 (Year: 2011).*

Song et al., machine translation CN 103898410, Jul. 2, 2014 (Year: 2014).*

Office Action (Text of the Second Office Action) issued by the State Intellectual Property Office of the People's Republic of China in corresponding Chinese Patent Application No. 201680008327.0, (English Translation only). (8 pages).

Search Report Completed on May 13, 2019 by the Taiwanese Patent Office in corresponding ROC Taiwan Patent Application No. 105103355, 1 page. (Partial English translation).

International Search Report (PCT/ISA/210) dated May 10, 2016, by the European Patent Office as the International Searching Authority for International Application No. PCT/EP2016/052048.

Written Opinion (PCT/ISA/237) dated May 10, 2016, by the European Patent Office as the International Searching Authority for International Application No. PCT/EP2016/052048.

Sanchez-Monjaras et al., Molten Salt Synthesis and Characterization of Potassium Polytitanate Ceramic Precursors with Varied $Ti0_2/K_20$ Molar Ratios, *Journal of the American Ceramic Society*, Sep. 1, 2008, pp. 3058-3065, vol. 91, No. 9. DOI:10.1111/j.1551-2916.2008.02574.x.

Office Action (Text of the First Office Action) dated Oct. 22, 2018, by the State Intellectual Property Office of the People's Republic of China in corresponding Chinese Patent Application No. 201680008327.0, and an English Translation of the Office Action, (16 pages).

Office Action (Second) dated Jul. 17, 2019, by the Chinese Patent Office in corresponding Chinese Patent Application No. 201680008327.0, and an English Translation of the Office Action. (19 pages).

Office Action dated Aug. 23, 2019, by the Federal Service for Intellectual Property in Russian Patent Application No. 2017130646/02 (053358) and an English Translation of the Office Action. (16 pages).

Office Action dated Aug. 17, 2021, in Brazilian Patent Application No. BR112017014277-5, English Translation only. (4 pages).

Office Action dated Aug. 31, 2021, in Taiwanese Patent Application No. 105103355, with English Translation only. (17 pages).

Office Action dated May 25, 2021, by the Japanese Patent Office in corresponding Japanese Patent Application No. 2017-558781, and an English Translation of the Office Action. (12 pages).

Office Action dated Jun. 14, 2021, by the Intellectual Property India—Government of India in corresponding Indian Patent Application No. 201717022001, with an English Translation. (6 pages).

Office Action dated Nov. 17, 2021, by the Mexican Institute of Industrial Property (IMPI) in corresponding Mexican Patent Application No. MX/a/2017/009985, and an English Translation of the Office Action (7 pages).

Office Action dated Jun. 22, 2021, by the Brazilian Institute of Industrial Property Journal (RPI) No. 2633 in corresponding Brazilian Patent Application No. BR112017014277-5, English Translation only. (7 pages).

Office Action (Notice of Reasons for Refusal) dated Jan. 31, 2022, by the Japanese Patent Office in corresponding Japanese Patent Application No. 2017-558781, and an English Translation of the Office Action. (60 pages).

Office Action dated Jul. 19, 2022, by the Mexican Institute of Industrial Property (IMPI) in corresponding Mexican Patent Application No. MX/a/2017/009985, with English translation, (8 pages).

* cited by examiner

New cutting edge before use

Edge wear after cutting Mix No 6 for 54 mm

Edge wear after cutting Mix No 7 for 3240 mm

Tool broke after cutting Mix No 18 for 1036m

Minor crater wear after cutting Mix No 19 for 4898m

POWDER METAL COMPOSITION FOR EASY MACHINING

TECHNICAL FIELD OF THE INVENTION

The invention refers to a powder metal composition for production of powder metal parts containing a new machinability enhancing agent, as well as a method for producing powder metal parts, having improved machinability.

BACKGROUND OF THE INVENTION

One of the major advantages of powder-metallurgical manufacture is that it becomes possible, by compacting and sintering, to produce components in final or very close to final shape. There are however instances where subsequent machining is required. For example, this may be necessary because of high tolerance demands or because the final component has such a shape that it cannot be pressed directly but requires machining after sintering. More specifically, geometries such as holes transverse to the compacting direction, undercuts and threads, call for subsequent machining.

By continuously developing new sintered steels with higher strength and higher hardness, machining has become a challenge in powder-metallurgical manufacture of components. It is often a limiting factor when assessing whether powder-metallurgical manufacture is the most cost-effective method for manufacturing a component.

Today, there are a number of known substances which are added to iron-based powder mixtures to facilitate the machining of components after sintering. The most common powder additive is MnS (manganese sulfide), which is mentioned e.g. in EP 0 183 666, describing how the machinability of a sintered steel is improved by the admixture of such powder.

U.S. Pat. No. 4,927,461 describes the addition of 0.01% and 0.5% by weight of hexagonal BN (boron nitride) to iron-based powder mixtures to improve machinability after sintering.

U.S. Pat. No. 5,631,431 relates to an additive for improving the machinability of iron-based powder compositions. According to this patent the additive contains calcium fluoride particles which are included in an amount of 0.1%-0.6% by weight of the powder composition.

The Japanese patent application JP08-095649 describes a machinability enhancing agent. The agent comprises $Al_2O_3$—$SiO_2$—CaO and has an anorthite or a gehlenite crystal structure. Anortithe is a tectosilicate, belonging to the feldspar group, having Mohs hardness of 6 to 6.5 and gehlenite is a sorosilicate having Mohs hardness of 5-6.

U.S. Pat. No. 7,300,490 describes a powder mixture for producing pressed and sintered parts consisting of a combination of manganese sulfide powder (MnS) and calcium phosphate powder or hydroxy apatite powder.

WO publication 2005/102567 discloses a combination of hexagonal boron nitride and calcium fluoride powders used as machining enhancing agent.

Boron containing powders such as boron oxide, boric acid or ammonium borate, in combination with sulphur is described in U.S. Pat. No. 5,938,814.

Other combinations of powder to be used as machining additives are described in EP 1985393A1, the combination containing at least one selected from talc and steatite and a fatty acid.

Talc as machining enhancing agent is mentioned in JP1-255604.

The application EP1002883 describes a powdered metal blend mixture for making metal parts, especially valve seat inserts. The blends described contain 0.5%-5% of solid lubricants in order to provide low friction and sliding wear as well as improvement in machinability. In one of the embodiments, mica is mentioned as a solid lubricant. These types of powder mixtures, used for production of wear resistant and high temperature stable components, always contain high amounts of alloying elements, typically above 10% by weight and hard phases, typically carbides.

U.S. Pat. No. 4,274,875 teaches a process for the production of articles, similar to what is described in EP1002883, by powder metallurgy including the step of adding powdered mica to the metal powder before compaction and sintering in amounts between 0.5%-2% by weight. Specifically, it is disclosed that any type of mica can be used.

Further, the Japanese patent application JP10317002, describes a powder or a sintered compact having a reduced friction coefficient. The powder has a chemical composition of 1%-10% by weight of sulphur, 3%-25% by weight of molybdenum and the balance iron. Further a solid lubricant and hard phase materials are added.

WO2010/074627 discloses an iron-based powder composition comprising, in addition to an iron-based powder, a minor amount of a machinability enhancing additive, said additive comprising at least one silicate from the group of phyllosilicates. Specific examples of the additive are muscovite, bentonite and kaolinite.

Machining of pressed and sintered components is very complex and is influenced by parameters such as type of alloying system of the component, the amount of alloying elements, sintering conditions such as temperature, atmosphere and cooling rate, sintered density of the component, size and shape of the component. It is also obvious that type of machining operation and speed of machining are parameters which have a great importance of the outcome of the machining operation. The diversity of proposed machining enhancing agents to be added to powder metallurgical compositions reflects the complex nature of the PM machining technology.

SUMMARY OF THE INVENTION

The present invention discloses a new additive containing a specified titanate, for improving the machinability of sintered steels. Specifically, the new additive facilitates machining operations such as drilling of sintered steels, in particular drilling of sintered components containing iron, copper and carbon such as connecting rods, main bearing caps and variable valve timing (VVT) components. Other machining operations, such as turning, milling, grooving, reaming, threading, etc., are also facilitated by the new machinability enhancing agent. When the new additive is added into prealloyed, diffusion alloyed, sinter-hardened steels and stainless steels excellent performance in improving the machinability can be achieved. Further, the new additive can be used in components to be machined by several types of tool materials such as high speed steel, tungsten carbides, cermets, ceramics and cubic boron nitride and the tool may also be coated.

OBJECTS OF THE INVENTION

An object of the present invention is to provide a new additive in a powder metal composition for improvement of machinability.

Another object of the present invention is to provide such additive to be used at various machining operations of different types of sintered steels.

Another object of the present invention is to provide a new machinability enhancing substance having no or negligible impact on the mechanical properties of the pressed and sintered component.

A further object of the invention is to provide a powder metallurgical composition containing the new machinability enhancing additive, as well as a method of preparing a compacted part from this composition.

Another object of the invention is to provide a sintered component having improved machinability, in particular sintered component containing iron-copper-carbon.

It has now been found that by including a machinability enhancing agent comprising a defined titanate compound in powder form to the iron-based powder composition, a surprisingly great improvement of the machinability of sintered components, made from the iron-based powder composition, is achieved. Furthermore, the positive effect on machinability is obtained even at very low added amounts, thus the negative impact on the compressibility by adding additional substances will be minimized. It has also been shown that the influence on the mechanical properties from the added titanate is acceptable.

According to the present invention, at least one of the above objects, as well as other objects evident from the below discussion, is achieved by the different aspects of the present invention.

DETAILED DESCRIPTION OF THE INVENTION

Figure 1:
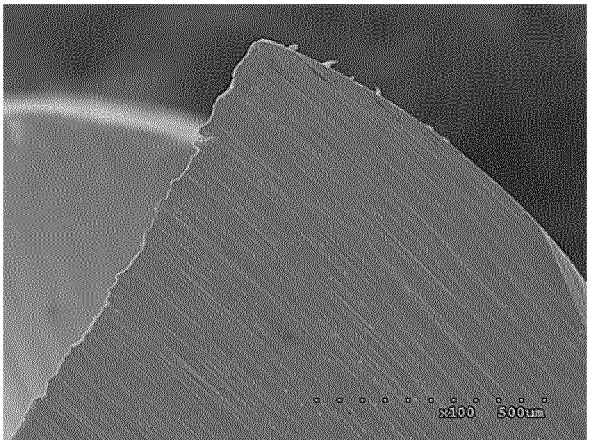
FIGS. 1 and 2 presents the cutting edge wear of the machining tools before and after machining the sintered samples.
Figure 1:
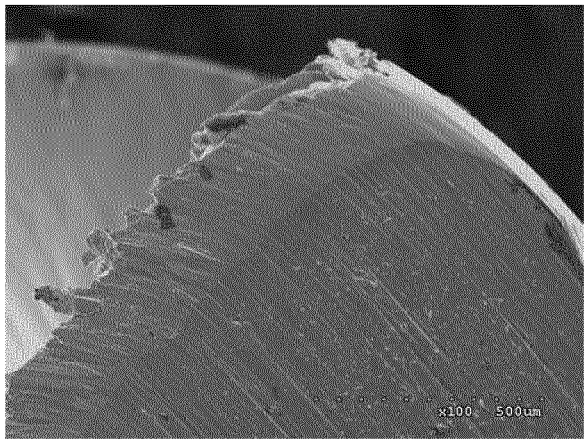
Figure 1:
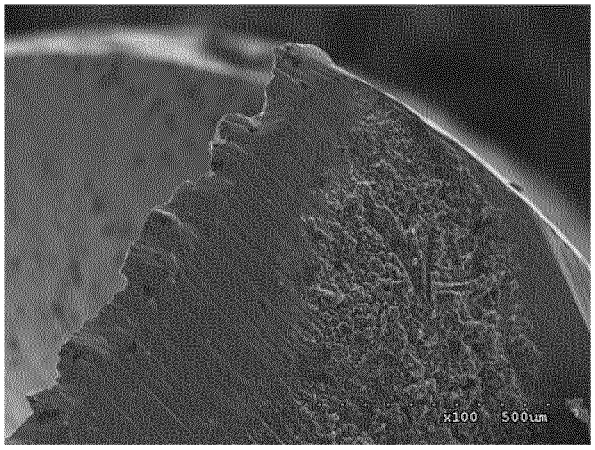

According to a first aspect of the present invention, there is provided an iron-based powder composition comprising at least an iron-based powder, and a small amount of a machinability enhancing additive in powder form, said additive comprising at least one synthetic titanate compound in powder form according to the following formula; MxO*nTiO2, wherein x can be 1 or 2 and n is a number from at least 1 and below 20, preferably below 10. M is an alkali metal such as Li, Na, K or an alkaline earth metal such as Mg, Ca, Ba, or combinations thereof. According to one embodiment of the first aspect the titanate contains at least one alkaline metal.

According to another embodiment of the first aspect, the titanate compound may be chosen from the group of lithium titanate, sodium titanate, potassium titanate, potassium lithium titanate, potassium magnesium titanate, barium titanate or mixtures thereof. According to another embodiment of the first aspect, the titanate compound may be chosen from the group of lithium titanate, sodium titanate, potassium titanate, potassium lithium titanate, potassium magnesium titanate or mixtures thereof, preferably the titanate compound is chosen from the group of potassium titanate and potassium magnesium titanate or mixtures thereof.

According to a second aspect of the present invention, there is provided a new machinability enhancing additive, said additive comprising at least one synthetic titanate compound in powder form according to the following formula; $M_xO*nTiO_2$, wherein x can be 1 or 2 and n is a number from from at least 1 and below 20, preferably below 10. M is an alkali metal such as Li, Na, K or an alkaline earth metal such as Mg, Ca, Ba, or combinations thereof.

In one embodiment of the second aspect the titanate contains at least one alkaline metal.

According to another embodiment of the second aspect, the titanate compound may be chosen from the group of lithium titanate, sodium titanate, potassium titanate, potassium lithium titanate, potassium magnesium titanate, barium titanate or mixture thereof. According to another embodiment of the second aspect, the titanate compound may be chosen from the group of lithium titanate, sodium titanate, potassium titanate, potassium lithium titanate, potassium magnesium titanate or mixtures thereof, preferably the titanate compound is chosen from the group of potassium titanate and potassium magnesium titanate or mixtures thereof.

According to a third aspect of the present invention, there is provided use of a titanate compound in powder form, comprised in a machinability improving additive in an iron-based powder composition. Said titanate being at least one synthetic titanate compound in powder form according to the following formula; $M_xO*nTiO_2$, wherein x can be 1 or 2 and n is a number from at least 1 and below 20, preferably below 10. M is an alkali metal such as Li, Na, K or an alkaline earth metal such as Mg, Ca, Ba, or combinations thereof.

In one embodiment of the third aspect the titanate contains at least one alkaline metal.

According to an embodiment of the third aspect, the titanate compound may be chosen from the group of lithium titanate, sodium titanate, potassium titanate, potassium lithium titanate, potassium magnesium titanate, barium titanate or mixture thereof. In another embodiment of the third aspect the titanate compound may be chosen from the group of lithium titanate, sodium titanate, potassium titanate, potassium lithium titanate, potassium magnesium titanate or mixture thereof, preferably the titanate compound is chosen from the group of potassium titanate and potassium magnesium titanate or mixtures thereof.

According to a fourth aspect of the present invention, there is provided a method of preparing an iron-based powder composition, comprising: providing an iron-based powder; and admixing the iron-based powder with a machinability enhancing additive, and with optional other materials, in powder form according to aspects above.

According to a fifth aspect of the present invention, there is provided method for producing an iron-based sintered component having improved machinability, comprising: preparing an iron-based powder composition according to the above aspect; compacting the iron-based powder composition at a compaction pressure of 400-1200 MPa; sintering the compacted part at a temperature of 700-1350° C.; and optionally heat treating the sintered component.

According to a sixth aspect of the present invention, there is provided a sintered component containing the new machinability enhancing agent according to aspect above. In one embodiment of the sixth aspect, the sintered component contains iron, copper and carbon. In another embodiment the sintered component is chosen from the group of connecting rods, main bearing caps and variable valve timing (VVT) components. According to another embodiment of the sixth aspect the sintered component contains one or more of other alloying elements such as Ni, Mo, Cr, Si, V, Co, Mn etc.

The machinability enhancing additive or agent comprises a defined titanate compound in powder form. The titanate in powder form has preferably a shape which is distinguished from fibrous titanate, having the same chemical composition, in that an average aspect ratio of the particles of the titanate compound is at most 5. The aspect ratio is defined as the ratio of the large dimension to one of the small dimensions, commonly it is defined as a ratio of average length to average diameter, i.e. the average length divided by the average diameter. The aspect ratio can be determined according to an image analysis under microscope. The titanate in fibrous form, i.e. the aspect ratio is more than 5, may be difficult to mix with other Fe-based powder composition to obtain a homogeneous mixture.

Titanate compound is a group of synthetic ceramic with the chemical formula MxO*nTiO2 where M=an alkali metal such as Li, Na, K or an alkaline earth metal such as Mg, Ca, Ba, or combinations thereof, so that x can be 1 or 2 and n is a number from 1 and above, and below 20, preferably below 10 and does not necessarily need to be an integer. Examples of titanate compounds which can be included in, or constitute the machinability enhancing additive according to the invention, are lithium titanate, sodium titanate, potassium titanate, potassium lithium titanate, potassium magnesium titanate and barium titanate or mixtures thereof; preferably the titanate compound is chosen from the group of potassium titanate and potassium magnesium titanate or mixtures thereof.

The machinability enhancing additive according to the invention may include or be mixed with other known machining enhancing additives such as manganese sulfide, hexagonal boron nitride, other boron containing substances, calcium fluoride, mica such as muscovite, talc, enstatite, bentonite, kaolinite etc.

The amount of machinability enhancing additive in the iron-based powder composition, and hence in the sintered component, may be between 0.05% and 1.0% by weight, preferably between 0.05% and 0.5%, preferably between 0.05% and 0.4%, preferably between 0.05% and 0.3% and more preferably between 0.1% and 0.3% by weight. Added amounts of titanate or machinability enhancing additive according the present invention in the iron-based powder composition, of particular interest are above 0.1% and less than 0.5% by weight, preferably above 0.12% and up to 0.4% by weight such as between 0.15% and 0.4% by weight and most preferably above 0.12% and up to 0.3% by weight such as between 0.15% and 0.3% by weight.

Lower amounts may not give the intended effect on machinability and higher amounts may have a negative influence on mechanical properties.

The particle size, X95, as measured according to SS-ISO 13320-1, of the titanate comprised in machinability enhancing additive according to the invention may be below 50 μm, preferably below 40 μm, more preferably below 30 μm, more preferably below 20 μm, such as below 15 μm or below 10 μm. Alternatively, or in addition, the mean particle size, X50, may be below 25 μm, preferably below 20 μm, more preferably below 15 μm, more preferably below 10 μm, such as 8 μm or below 5 μm. However, the particle size is more than 0.1 μm, preferably more than 0.5 μm, i.e. at least 95% by weight of the particles may be more than 0.5 μm. If the particle size is below 0.5 μm, it may be difficult to mix the additive with other Fe-based powder compositions to obtain a homogeneous powder mixture. Too fine particle size will also negatively influence sintering properties. A particle size above 50 μm may negatively influence the machinability and mechanical properties.

Thus, examples of preferred particle size distributions of the titanates, contained in the machinability enhancing agent according to the present invention, are;

X95 below 50 μm, X50 below 25 μm and at least 95% by weight above 0.1 μm, or,

X95 below 30 μm, X50 below 15 μm and at least 95% by weight above 0.1 μm, or,

X95 below 20 μm, X50 below 10 μm and at least 95% by weight above 0.5 μm.

Iron Based Powder Composition

The machinability enhancing additive according to the invention can be used in essentially any ferrous powder compositions. Thus the iron-based powder, comprised in the iron based powder composition, may be a pure iron powder such as atomized iron powder, reduced iron powder, and the like. Also pre-alloyed powders such as low alloyed steel powder and stainless steel powder including alloying elements such as Ni, Mo, Cr, Si, V, Co, Mn, Cu, may be used, as well as partially alloyed steel powder where the alloying elements is diffusion bonded to the surface of the iron based powder. The iron based powder composition may also contain alloying elements in powder form, i.e. a powder or powders containing alloying element(s) are present in the iron based powder composition as discrete particles.

The machinability enhancing additive is present in the composition in powder form. The additive powder particles may be mixed with the iron-based powder composition as free powder particles or be bound to the iron-based powder particles e.g. by means of a binding agent.

The iron based powder composition according to the invention may also include other additives such as graphite, binders and lubricants and other conventional machinability enhancing agents. Lubricant may be added at 0.05%-2% by weight, preferably 0.1%-1% by weight. Graphite may be added at 0.05%-2% by weight, preferably 0.1%-1% by weight.

Process

The powder-metallurgical manufacture of components according to the invention may be performed in a conventional manner, i.e. by the following process: iron-based powder, e.g. the iron or steel powder, may be admixed with any desired alloying elements, such as nickel, copper, molybdenum and optionally carbon as well as the machinability enhancing additive according to the invention. The alloying elements may also be added as prealloyed or diffusion alloyed to the iron based powder or as a combination between admixed alloying elements, diffusion alloyed powder or prealloyed powder. This powder mixture may be admixed with a conventional lubricant, for instance zinc stearate or amide wax, prior to compacting. Finer particles in the mix may be bonded to the iron based powder by means of a binding substance for minimizing segregation and improving flowability of the powder mixture. The powder mixture may thereafter be compacted in a press tool yielding what is known as a green body of close to final geometry. Compacting generally takes place at a pressure of 400-1200 MPa. After compacting, the compact may be sintered at a temperature of 700-1350° C. and is given its final strength, hardness, elongation etc. Optionally, the sintered part may be further heat-treated to achieve desired microstructures.

EXAMPLES

The present invention will be illustrated in the following non-limiting examples:

Machinability Enhancing Agents

The substances according to the following table (table 1) were used as examples of the machinability enhancing agents according to the invention.

TABLE 1 chemical composition of used machinability enhancing agents

| Machinability enhancing agent | ID | % wt $TiO_2$ | % wt BaO | % wt CaO | . % wt $K_2O$ | % wt $Na_2O$ | .% wt MgO | % wt $Li_2O_2$ | % wt other oxides* | $TiO_2$/MxO mole ratio** |
|---|---|---|---|---|---|---|---|---|---|---|
| Lithium titanate | LT | 85.9 | | | | | | 5.6 | 8.5 | 5.7 |
| Potassium lithium titanate | PLT | 79.9 | | | 15.0 | | | 1.3 | 3.8 | 4.9 |
| Potassium titanate | PT | 76.3 | | | 20.8 | | | | 2.9 | 4.3 |
| Potassium magnesium titanate | PMT | 66.6 | | | 20.3 | | 10.9 | | 2.2 | 1.7 |
| Sodium titanate | ST | 81.0 | | | | 14.4 | | | 4.6 | 4.4 |
| Barium Titanate | BT | 33.9 | 65.1 | | | | | | 1.0 | 1.0 |
| Calcium Titanate | CT | 58.3 | | 40.9 | | | | | 0.8 | 1.0 |

*other oxides include $SiO_2$, $Al_2O_3$, $ZrO_2$, $Fe_2O_3$

**the ratio is displayed as the 'n' number in the titanate formula, $M_xO*nTiO_2$ Table 2 shows the typical particle size distribution, as measured according to SS-ISO 13320-1, for the substances listed in table 1.

TABLE 2 typical particle size distribution of substances according to table 1

| | X10 | X50 | X90 | X95 |
|---|---|---|---|---|
| Size μm | 1.6 | 4.5 | 22.3 | 38.0 |

Example 1

Five iron-based powder compositions were prepared by mixing the pure atomized iron powder ASC100.29 available from Höganäs AB, Sweden, 2 weight % of a copper powder Cu165 available from ACuPowder, USA, 0.85 weight % of a graphite powder Gr1651 available from Asbury Graphite, USA, and 0.75 weight % of a lubricant, Acrawax C available from Lonza, USA. Mix No 1 was used as reference and did not contain any machinability enhancing substance whereas mixes No 2-5 contained 0.15% by weight of a machinability enhancing agent according to the invention.

The mixes were compacted into Transvers Rapture Strength (TRS) samples according to SS-ISO 3325 to a green density of 6.8 g/cm$^3$, followed by sintering at 1120° C. in an atmosphere of 90% nitrogen/10% hydrogen for a period of time of 30 minutes. After cooling to ambient temperature the samples were tested for transvers rapture strength according to SS-ISO 3325, hardness (HRB) according to SS-EN ISO 6506. Dimensional change (DC) between compaction die and sintered samples was also measured.

TABLE 3 results from mechanical testing

| Mix No | Machinability enhancing agent | DC [%] | HRB | TRS (MPa) |
|---|---|---|---|---|
| 1 | — | 0.28 | 76 | 990 |
| 2 | 0.15% LT | 0.27 | 74 | 993 |
| 3 | 0.15% PT | 0.30 | 75 | 986 |

TABLE 3-continued results from mechanical testing

| Mix No | Machinability enhancing agent | DC [%] | HRB | TRS (MPa) |
|---|---|---|---|---|
| 4 | 0.15% PMT | 0.28 | 73 | 972 |
| 5 | 0.15% ST | 0.32 | 75 | 980 |

As evident from table 3 the addition of the various machinability enhancing agents according to the invention, added at a content of 0.15% by weight, has no significant influence on the sintered and mechanical properties.

In addition, the mixes were compacted into green samples in a shape of rings, height=20 mm, inner diameter=35 mm, outer diameter=55 mm, by uniaxial pressing to a green density of 6.9 g/cm$^3$ followed by sintering at 1120° C. in an atmosphere of 90% nitrogen/10% hydrogen for a period of time of 30 minutes. After cooling to ambient temperature the samples were tested for machinability.

Machinability tests were conducted using ⅛ inch plain (uncoated) high speed steel drill bits to drill blind holes with a depth of 18 mm in wet conditions, i.e. with coolant. The various machinability enhancing agents according to the invention were evaluated with respect to total cutting distance before drill failure, e.g. excessive worn or broken cutting tool. Table 4 shows the results from the machinability testing.

TABLE 4 results from machinability test.

| Mix no | Machinability enhancing agent | Cutting speed [meter/minutes] | Feed [mm/revolution] | Cutting distance [mm] |
|---|---|---|---|---|
| 1 | — | 200 | 0.2 | 126 |
| 2 | 0.15% LT | 200 | 0.2 | 1656 |
| 3 | 0.15% PT | 200 | 0.2 | 2232 |
| 4 | 0.15% PMT | 200 | 0.2 | 1994 |
| 5 | 0.15% ST | 200 | 0.2 | 1530 |

Table 4 clearly shows that all of the tested machinability enhancing agents according to the invention provides great improvement in machinability of the sintered material compared to the material without the enhancing agent.

Example 2

The following example illustrates the impact of particle size of the machinability enhancing agent potassium titanate on the machinability. Similar iron-based powder compositions as described in example 1 was prepared with the exception of that potassium titanate having various particle size distributions were used. Sintered samples according to example 1 were prepared and similar drill testing as described in example 1 was conducted. The following table 5 shows the machining parameters and results.

TABLE 5 machining parameters and results from machinability test

| Mix no | Machinability enhancing agent | Cutting speed [meter/minutes] | Feed [mm/revolution] | Cutting distance [mm] |
|---|---|---|---|---|
| 6 | — | 400 | 0.1 | 54 |
| 7 | 0.15% PT, X95 = 9 μm | 400 | 0.1 | 3240* |
| 8 | 0.15% PT, X95 = 13 μm | 400 | 0.1 | 3240* |
| 9 | 0.15% PT, X95 = 16 μm | 400 | 0.1 | 3240* |
| 10 | 0.15% PT, X95 = 38 μm | 400 | 0.1 | 954 |

*test was terminated without tool broke

For mix No 7-9 no cutting tool failure was obtained even after a cutting of 3240 mm, for mix No 10 cutting tool failure was obtained after 954 mm cutting distance which yet is a huge improvement compared to result obtained from the mix No 6 having no addition of machinability enhancing agent. FIG. 1 presents the cutting edge wear of the drill bit before and after machining. The figure reveals that the machinability enhancing agent according to the invention mitigates the cutting edge wear to a surprisingly high level. Only minor wear can be detected after 3240 mm cutting distance compared to the excessive cutting edge wear which resulted tool broke after only 54 mm cutting distance when no machinability enhancing agent is used.

Example 3

The following example illustrates the effect of the machinability enhancing agent according to the invention compared to known such agents. In the comparative iron-based powder compositions known machinability enhancing agents were used: in mix No 12, a calcium fluoride powder having a particle size distribution of X95=9 μm and in mix No 13 a manganese sulphide powder, MnS, having a particle size distribution of X95=10 μm. Mix No 14-16, 16a and 16b contained the machinability enhancing agent according to the invention as the same as described in example 2, mix No 7. Iron-based powder compositions and test samples was prepared according to the description in example 1. Machinability test was performed according to example 1 with the exception of TiN coated high speed steel drills was used, the drills having a diameter of ⅛ inch and holes were drilled in dry condition, i.e. without coolant, to a depth of 10 mm.

The following table 6 shows machinability enhancing additive and results from the testing.

TABLE 6 machining parameters and results from machinability test

| Mix no | Machinability enhancing agent | Cutting speed [meter/minutes] | Feed [mm/revolution] | Cutting distance [mm] |
|---|---|---|---|---|
| 11 | — | 200 | 0.2 | 400 |
| 12 | 0.3% calcium fluoride | 200 | 0.2 | 2130 |
| 13 | 0.5% MnS | 200 | 0.2 | 3600* |
| 14 | 0.05% PT | 200 | 0.2 | 850 |
| 15 | 0.10% PT | 200 | 0.2 | 2160 |
| 16 | 0.15% PT | 200 | 0.2 | 3600* |
| 16a | 0.30% PT | 200 | 0.2 | 3600* |
| 16b | 0.50% PT | 200 | 0.2 | 3600* |

*test was terminated without tool broke

Machinability testing of samples made from mix No 13 and 16, 16a and 16b were stopped after cutting distance of 3600 mm without tool failure. The results show that when the machinability enhancing agent according to the invention was added in an amount less than 0.15% by weight, the performance in improving machinability was limited and inconsistent. However, even amounts as low as 0.05% it still gives some improvement compared to when no machinability enhancing agent is used.

Before compaction, Hall Flow according to ISO 4490-2008 was determined for the mixtures according to the following table 6a. Transvers rapture strength (TRS) samples according to SS-ISO 3325 were prepared in the same manner as described in example 1. Green strength according to ISO 3995-1985 was determined on some of the non-sintered green TRS samples and the remaining TRS samples were subjected to a sintering process and thereafter tested for transvers rapture strength as described in example 1. Dimensional change between compaction die and sintered samples were also determined.

Table 6a presents the results from the Hall flow test, the green strength test on non-sintered samples, determination of dimensional change between the die and sintered samples and test of transverse rupture strength of the sintered samples.

TABLE 6a

Flow, Green Strength (GS), Dimensional Change (DC) and Transverse rupture strength (TRS)

| Mix No | Machinability enhancing agent | Flow [sec/50 g] | GS [MPA] | DC [%] | TRS [MPA] |
|---|---|---|---|---|---|
| 11 | — | 29.5 | 12 | 0.30 | 1020 |
| 16 | 0.15% PT | 30.2 | 12 | 0.32 | 1000 |
| 16a | 0.30% PT | 31.3 | 11 | 0.35 | 958 |
| 16b | 0.50% PT | 38.0 | 8 | 0.48 | 855 |
| 16c | 0.75% PT | No flow | 6 | 0.52 | 800 |

As evident from table 6a, additions of the titanate at a content of 0.5% or more, material properties such as flow of the powder mixture, green strength of compacted samples, dimensional change and transverse rupture strength are significantly affected.

Example 4

The following example illustrates the effect of the machinability improving agent according to the invention compared to known such agents when cutting sinter-hardened samples containing more than 90% martensitic microstructure. The iron-based powder compositions were prepared by mixing a pre-alloyed iron powder Astaloy MoNi (Fe+1.2% Mo+1.35% Ni+0.4% Mn) available from North American Höganäs, USA, 2 weight % of a copper powder Cu165 available from ACuPowder, USA, 0.9 weight % of a graphite powder Gr1651 available from Asbury Graphite, USA, and 0.6 weight % of a lubricant, Introlube E available from Höganäs AB, Sweden. Mix No 17 was used as reference and did not contain any machinability enhancing agent whereas mix No 18 contained 0.5% by weight of a known machinability enhancing agent manganese sulphide, MnS, described in example 3. Mix No 19 contained 0.15% by weight of the machinability enhancing agent according to the invention as described in example 3.

The mixes were compacted into green samples in a shape of rings according to the description in example 1. The green samples were then sintered according to the description in example 1 except a cooling rate of 2 degree Celsius per second was used to cool the samples to ambient temperature. After being tempered at 204° C. for one hour in air, the samples were used for machinability tests.

The machinability test was performed in a turning operation. Cubic boron nitride (cBN) inserts were used to cut the samples in dry condition, i.e. without coolant, until excessive tool wear (more than 200 μm) was observed.

The following table 7 shows machining parameters and results from the machinability test.

TABLE 7 machining parameters and results from the machinability test

| Mix no | Machinability enhancing agent | Cutting speed [meter/minutes] | Feed [mm/revolution] | Cutting distance [m] | Tool wear (μm) |
|---|---|---|---|---|---|
| 17 | — | 183 | 0.3 | 754 | broken |
| 18 | 0.5% MnS | 183 | 0.3 | 1036 | broken |
| 19 | 0.15% PT | 183 | 0.3 | 4898 | 54* |

*test was terminated with minor crater tool wear

Figure 2:
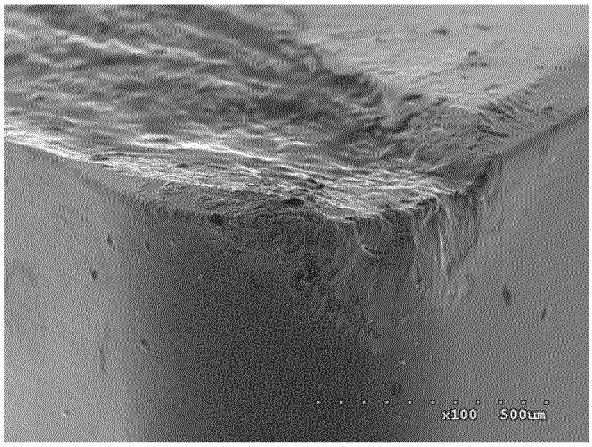
Figure 2:
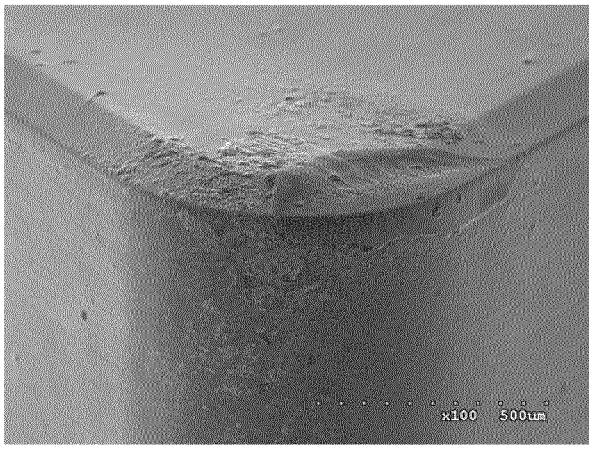

FIG. 2 presents the status of tool wear after the machining of the samples containing machinability enhancing agent. The table and figure reveal that the machinability enhancing agent according to the invention mitigates the tool wear to a surprisingly high level. Only minor crater wear can be detected after 4898 m cutting distance, compared to the broken tool observed after 754 m cutting distance when no machinability enhancing agent was used and the broken tools observed after 1036 m cutting distance when the known machinability enhancing agent MnS was used. It is thus proven that the machinability enhancing agent according to the invention can provide great machinability improvement for sinter-hardened steels.

Example 5

The following example illustrates the effect of the machinability improving agent according to the invention compared to known such agents when cutting stainless steel samples. The iron-based powder compositions were prepared by mixing a 304L stainless steel powder (Fe+18.5% Cr+11% Ni+0.9% Si) available from North American Höganäs, USA, and 1.0 weight % of a lubricant, Acrawax C available from Lonza, USA. Mix No 20 was used as reference and did not contain any machinability enhancing agent whereas mix No 21 contained 0.5% by weight of known machinability enhancing agent manganese sulphide, MnS, described in example 3. Mix No 22 contained 0.15% by weight of the machinability enhancing agent according to the invention as described in example 3.

The mixes were compacted into green samples in a shape of rings according to the description in example 1 to a green density of 6.5 g/cm$^3$ followed by sintering at 1315° C. in an atmosphere of 100% hydrogen for a period of time of 45 minutes. After cooling to ambient temperature the samples were used for machinability tests.

The machinability test was performed in a turning operation. Coated tungsten carbide inserts were used to cut the samples in wet condition, i.e. with coolant, until excessive tool wear (more than 200 μm) was observed.

The following table 8 shows machining parameters and results from the machinability test.

TABLE 8 machining parameters and results from the machinability test

| Mix no | Machinability enhancing agent | Cutting speed [meter/minutes] | Feed [mm/revolution] | Cutting distance [m] | Tool wear (μm) |
|---|---|---|---|---|---|
| 20 | — | 274 | 0.2 | 5087 | 373 |
| 21 | 0.5% MnS | 274 | 0.2 | 5087 | 204 |
| 22 | 0.15% PT | 274 | 0.2 | 5087 | 65 |

For mix No 22 only minor initial tool wear was obtained after a cutting of 5087 mm whereas for mix No 20 and 21 excessive tool wear was obtained after cutting the same distance. The results show that the machinability enhancing agent according to the invention facilitates machining operation far better than the known machinability enhancing agent MnS, although the machinability enhancing agent according to the invention was added in a less amount. It can also be noted that in as small content as 0.15% the machinability enhancing agent according to the invention has superior effect on improving the machinability of stainless steels.

Example 6

This example shows the impact for the machinability enhancing agent according to the invention on corrosion of sintered samples.

Iron-based powder compositions, as described in example 1, were prepared. One composition contained no machinability enhancing agent, another composition contained 0.5% by weight of MnS and a third composition contained 0.15% potassium titanate having X95=9 μm. Green and sintered samples in the shape of rings were prepared as described in example 1. The sintered samples were thereafter placed in a humidity chamber at 45° C. and a relative humidity of 95%. The samples were visually examined at the start of the test, after one day and after four days.

Figure 3:
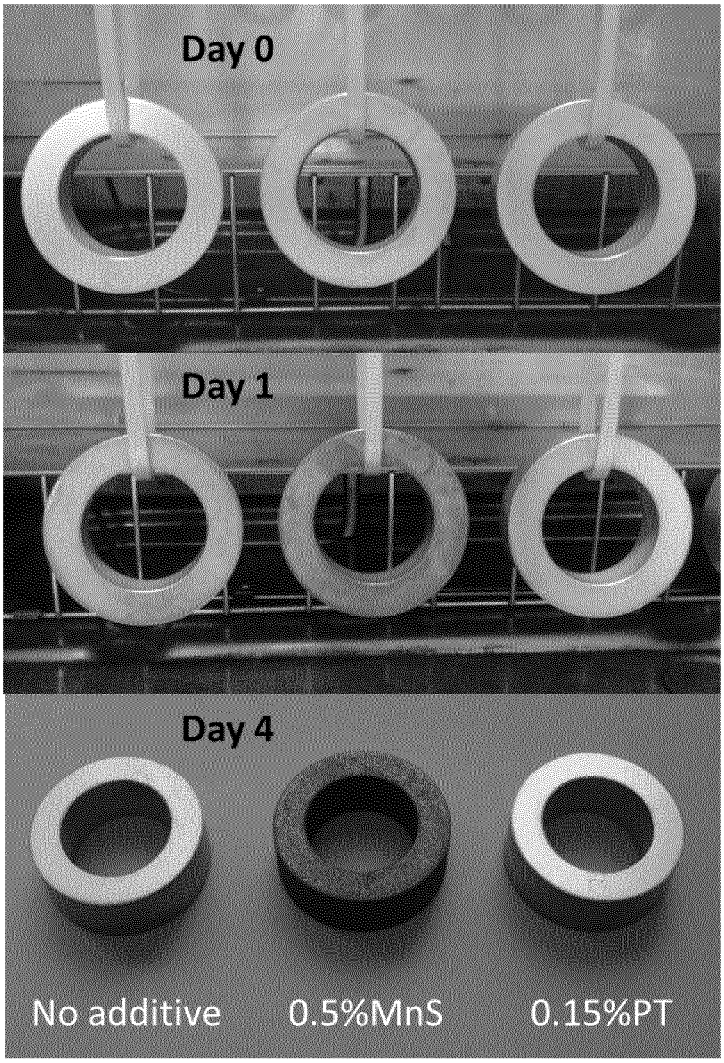
FIG. 3 shows sintered samples subjected to corrosion test.

FIG. 3 shows that hardly any corrosion could be detected after four days for the sample containing the new machinability enhancing agent, in contrast to the sample containing MnS which exhibit severe corrosion. When compared to the samples without any added machinability enhancing agent it may even be concluded that the machinability enhancing agent according to the invention has some corrosion protective effect.

Example 7

Example 7 illustrates that when the titanate as the machinability enhancing agent does not contain any alkaline metal, i.e. consists of an alkaline earth metal titanate, the machinability is only affected to a limited extent.

Four iron-based powder compositions were prepared by mixing the pure atomized iron powder ASC100.29 available from Höganäs AB, Sweden, 2 weight % of a copper powder Cu165 available from ACuPowder, USA, 0.85 weight % of a graphite powder Gr1651 available from Asbury Graphite, USA, and 0.75 weight % of a lubricant, Acrawax C available from Lonza, USA. Mix No 23 was used as reference and did not contain any machinability enhancing substance whereas mixes No 24-26 contained 0.15% by weight of a machinability enhancing agent. The particle size of the substance PT was X95=9 μm, for substance BT the particle size was X95=7 um, and for the substance CT the particle size was X95=10 um.

The mixes were compacted into green samples in a shape of rings, height=20 mm, inner diameter=35 mm, outer diameter=55 mm, by uniaxial pressing to a green density of 6.9 g/cm$^3$ followed by sintering at 1120° C. in an atmosphere of 90% nitrogen/10% hydrogen for a period of time of 30 minutes. After cooling to ambient temperature the samples were tested for machinability. Machinability tests were conducted using ⅛ inch plain (uncoated) high speed steel drill bits to drill blind holes with a depth of 18 mm in wet conditions, i.e. with coolant. The machinability enhancing agents were evaluated with respect to total cutting distance before drill failure, e.g. excessive worn or broken cutting tool. Table 9 shows the results from the machinability testing.

TABLE 9 machining parameters and results from the machinability test

| Mix no | Machinability enhancing agent | Cutting speed [meter/minutes] | Feed [mm/revolution] | Cutting distance [m] |
|---|---|---|---|---|
| 23 | — | 300 | 0.13 | 54 |
| 24 | 0.15% PT | 300 | 0.13 | 1296* |
| 25 | 0.15% BT | 300 | 0.13 | 198 |
| 26 | 0.15% CT | 300 | 0.13 | 90 |

*test was terminated without tool broke

Table 9 shows that limited improvement was obtained for mix 26 compared to the significant improvement of machinability noted for the sample according to the invention, mix no. 24. Mix no 25 shows some improvements.

The invention claimed is:

1. An iron-based powder composition comprising a minor amount of a machinability enhancing additive, said machinability enhancing additive comprising at least one synthetic titanate compound in powder form, the synthetic titanate compound being according to the following formula;

MxO*nTiO2, wherein x can be 1 or 2, n is a number from at least 1 and below 20 and M is an alkali metal or an alkaline earth metal or combinations thereof, wherein the content of the synthetic titanate compound is above 0.15% and less than 0.5% by weight of the iron-based powder composition;

wherein the synthetic titanate compound has an X95 particle size below 20 μm and at least 95% by weight of synthetic titanate particles have a particle size more than 0.5 μm, and wherein the aspect ratio of the synthetic titanate compound particles is at most 5.

2. The iron-based powder composition according to claim 1, wherein the synthetic titanate compound contains at least one alkali metal.

3. The iron-based powder composition according to claim 2, wherein the synthetic titanate compound is chosen from the group consisting of potassium titanate and potassium magnesium titanate and mixtures thereof.

4. The iron-based powder composition according to claim 1, wherein the synthetic titanate compound is chosen from the group consisting of lithium titanate, sodium titanate, potassium titanate, potassium lithium titanate, potassium magnesium titanate, barium titanate and mixtures thereof.

5. The iron-based powder composition according to claim 1, wherein the synthetic titanate compound is chosen from the group consisting of lithium titanate, sodium titanate, potassium titanate, potassium lithium titanate, potassium magnesium titanate and mixtures thereof.

6. The iron-based powder composition according to claim 1, wherein the X95 particle size is below 15 μm.

7. The iron-based powder composition according to claim 1, wherein the synthetic titanate compound has an X50 particle size below 15 μm.

8. The iron-based powder composition according to claim 1, wherein the synthetic titanate compound has an X50 particle size below 10 μm.

9. The method for producing an iron-based sintered part having improved machinability, comprising:

preparing the iron-based powder composition according to claim 1;

compacting the iron-based powder composition at a compaction pressure of 400-1200 MPa;

sintering the compacted part at a temperature of 700-1350° C.; and optionally heat treating the sintered part.

* * * * *